US005758877A

United States Patent [19]

Liddell

[11] Patent Number: 5,758,877

[45] Date of Patent: Jun. 2, 1998

[54] APPARATUS FOR PLAYING A GAME

[76] Inventor: Thomas W. Liddell, 26 The Bullring, Ludlow, Shropshire SY8 1AA, United Kingdom

[21] Appl. No.: 751,467

[22] Filed: Nov. 19, 1996

[30] Foreign Application Priority Data

Nov. 20, 1995 [GB] United Kingdom ..... 9523712
Apr. 22, 1996 [GB] United Kingdom ..... 9608313

[51] Int. Cl.[6] ..... A63F 3/00; A63F 9/18

[52] U.S. Cl. ..... 273/249; 273/431

[58] Field of Search ..... 273/243, 249, 273/250–254, 429–432

[56] References Cited

U.S. PATENT DOCUMENTS

| | | | |
|---|---|---|---|
| 4,216,594 | 8/1980 | Farley et al. | 273/243 |
| 4,889,345 | 12/1989 | Wawryk | 273/249 |
| 4,923,198 | 5/1990 | Diaz | 273/240 |

FOREIGN PATENT DOCUMENTS

| | | | |
|---|---|---|---|
| 2738798 | 3/1979 | Germany | 273/249 |
| 2 187 393 | 9/1987 | United Kingdom | 273/249 |
| 2 223 177 | 4/1990 | United Kingdom | 27/242 |
| 2 236 257 | 4/1991 | United Kingdom . | |
| 2 254 565 | 10/1992 | United Kingdom | 273/249 |
| 2 270 476 | 3/1994 | United Kingdom | 273/242 |
| 2270476 | 3/1994 | United Kingdom | 273/242 |

*Primary Examiner*—Benjamin H. Layno
*Attorney, Agent, or Firm*—Westman, Champlin & Kelly, P.A.

[57] ABSTRACT

The present invention provides in a first aspect, with reference to FIGS. 1, 2, 3, 4 and 5, apparatus for playing a game comprising a board (10) marked in a particular manner, a plurality of playing pieces (20) and a plurality of question cards (30), the playing pieces (20) being movable by throwing dice (40, 50) in accordance with specified rules. A playing path is defined on the board (10) along which the playing pieces (20) are moved during the game. The playing path comprises a plurality of segments (11) defining locations for the playing pieces (20) during the game, the segments (11) being of a plurality of different identifiable types. The question cards (30) are divided into a plurality of different categories, the number of categories of question cards (30) matching the number of types of segments (11). The playing path is divided into at least three levels, the rules specifying that the playing pieces (20) must start on a first level and then move through at least one intermediate level to an ultimate level. In a second aspect of the present invention there is provided a game in which the playing means (10, 20, 30, 40, 50) are replaced by electrical or electronic apparatus (100) comprising display means (101) and input means (102, 103).

16 Claims, 3 Drawing Sheets

APPARATUS FOR PLAYING A GAME

The present invention relates to a game and in particular to a game in which playing pieces are advanced along a playing path.

In the past, games have been played in which the progress of a playing piece along a playing path is determined by a throw of a dice or an answering of a question. In the past, in such games, the chances of competing playing pieces reaching a finish line first are dependent upon either the probability of the throw of a dice and/or the skill of a player answering a question.

It is an object of the present invention to be of a theme which simulates a realistic and identifiable situation, which theme enables tactical play to add a further dimension of player interaction and direct challenges to the standard probability means offered and question answering required by prior art games.

The present invention provides in a first aspect apparatus for playing a game comprising a plurality of playing pieces, a board marked in a particular manner and a plurality of question cards, the playing pieces being movable in accordance with specified rules, wherein:

which a playing path is defined on the board along which the playing pieces are moved during the game;

the playing path comprises a plurality of segments defining locations for the playing pieces during the game, the segments being of a plurality of different identifiable types;

the question cards are divided into a plurality of different categories, the number of categories of the question cards matching the number of types of segments;

the rules specify that when a playing piece is placed on a Segment a player must answer a question from a question card of a category determined by the type of the segment;

the playing path is divided into at least three levels, the rules specifying that the playing pieces must start on a first level and then move through at least one intermediate level to an ultimate level; and rules specify that to move a playing piece from a first level to a second level nearer to the ultimate level or from a penultimate intermediate level to the ultimate level, a player must answer correctly a question read from a question card.

In a second aspect of the present invention there is provided apparatus for playing a game comprising electrical or electronic apparatus having display means and input means for use by a plurality of players wherein the display means during the game displays a playing path, playing pieces movable along the playing path ad text of questions and corresponding answers, the playing pieces being movable in accordance with specified rules, wherein:

the displayed playing path comprises a plurality of segments defining locations for the playing pieces during the game, the segments being of a plurality of different identifiable types;

the questions are categorised into a plurality of different categories, the number of categories of the question cards matching the number of types of segment;

the apparatus when a playing piece reaches a segment displays a question of a category determined by the type of the segment;

the playing path is divided into at least three levels, and the apparatus requiring each playing piece to start at a first level and then move through at least one intermediate level to an ultimate level; and the apparatus requiring that a question is correctly answered before moving a playing piece from a first level to a second level nearer to the ultimate level or from a penultimate level to the ultimate level.

Preferred embodiments of the game according to the present invention will now be described with reference to the accompanying drawings in which.

Figure 1:
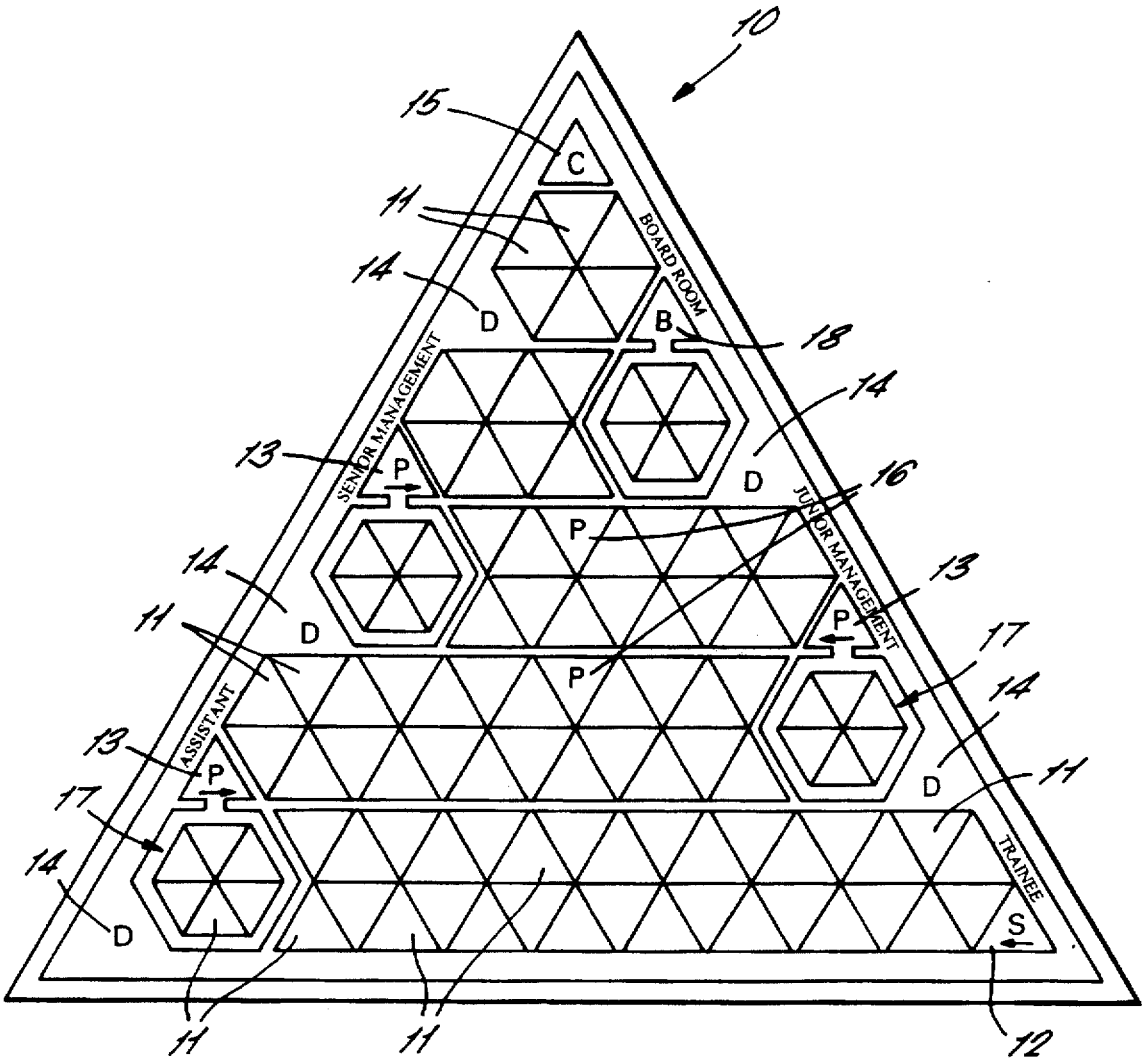
FIG. 1 is a plan view of a playing board of a first embodiment of the game showing the playing path.
Figure 2:
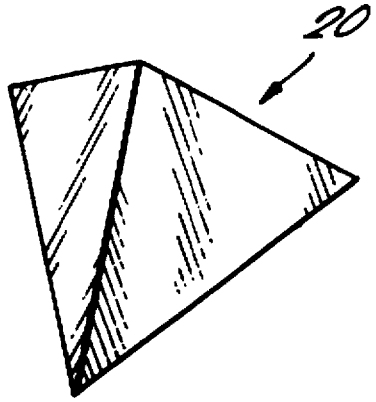
FIG. 2 illustrates a tetrahedral playing piece of the game.
Figure 4:
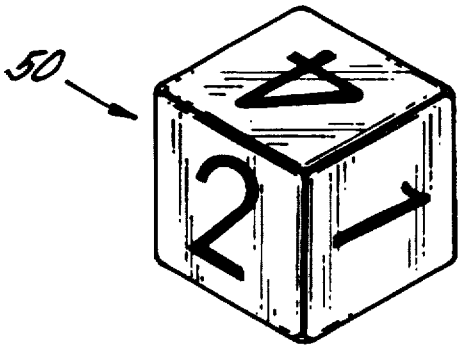
FIG. 4 illustrates a 'difficulty' dice consisting of six differently numbered sides.
Figure 3:
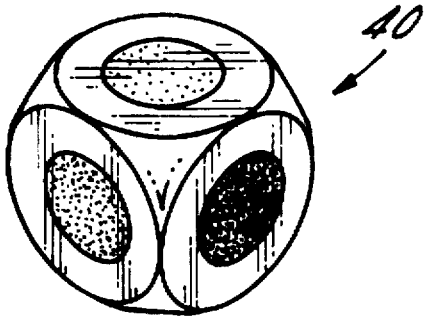
FIG. 3 shows a 'category' dice consisting of six differently coloured sides.
Figure 5:
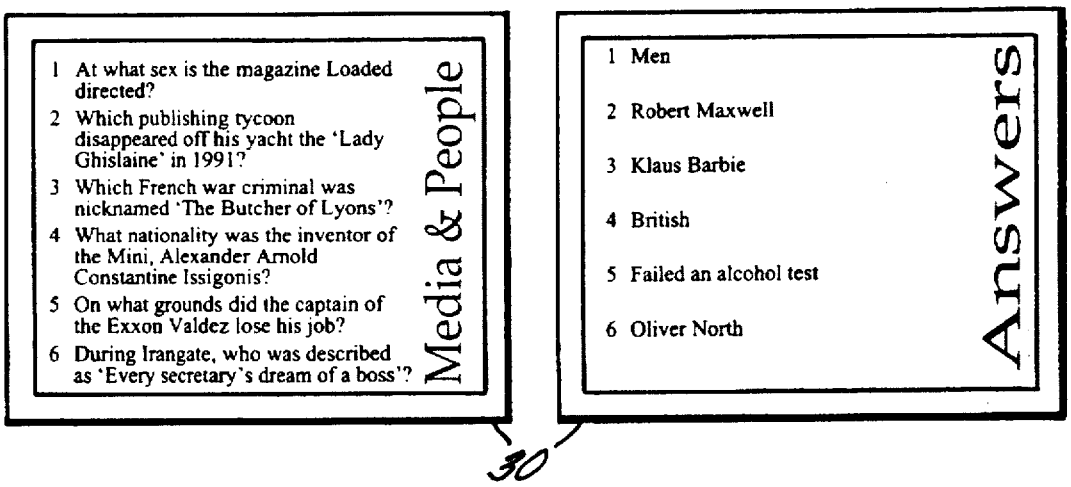
FIG. 5 shows a question card from one of the six available categories, which illustrates the six levels of difficulty of question.
Figure 6:
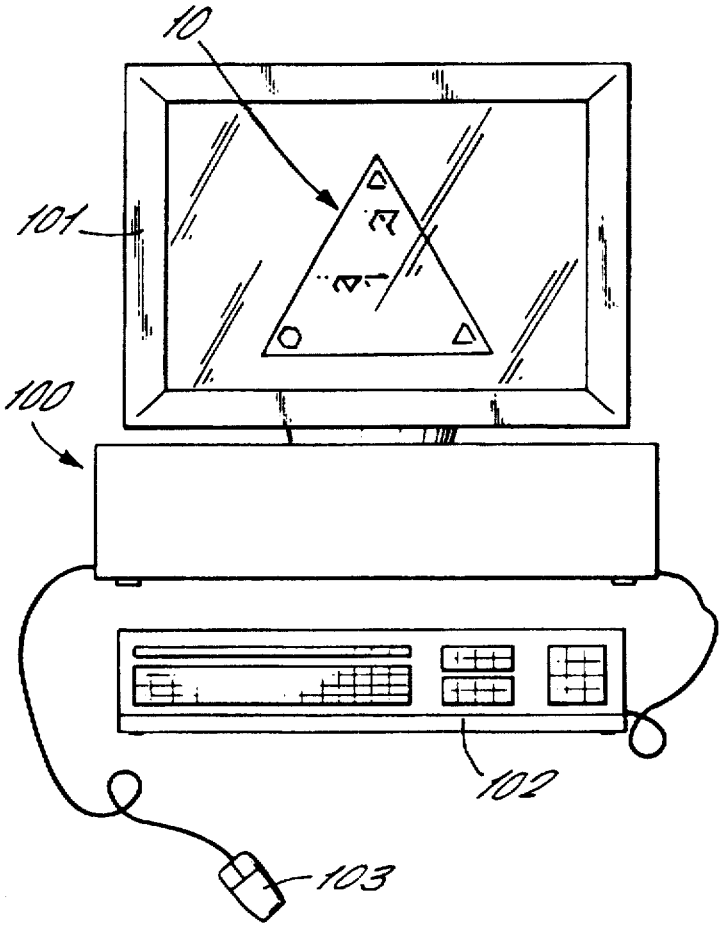
FIG. 6 illustrates electrical and electronic apparatus of a second embodiment of the game.

The preferred embodiment of the present invention provides a triangular playing board 10 having a plurality of coloured triangles 11 printed thereon, which triangles 11 are positioned so as to define a playing path.

The playing path comprises a white start triangle 12 in the bottom right-hand corner of the playing board 10, a white chairman's triangle 15 at the top apex, and five levels of hierarchy therebetween, each comprising a promotion triangle 13 denoted by a 'P' and a demotion triangle 14 denoted by a 'D'. The first level, trainee, accordingly corresponds to the lowest, widest level on the playing board 10, and forms the base of a pyramid structure upon which each of the successive levels are built, forming a hierarchy which narrows within the confines of the triangular playing board 10. The successive levels correspond to assistant, junior management, senior management, and board room respectively.

Within each level there is at a first end a white triangle ('S' triangle 12 on the first level or 'P' triangle 13 on successive levels), a black 'D' triangle 14 at the other end, and two horizontal rows of coloured triangles 11 therebetween, wherein each successive triangle 11 of each row is inverted with respect to the former so as to tessellate, said rows culminating in a defined hexagon 17 of triangles 11. The coloured triangles 11 are positioned in an ordered pattern so that each of the six game colours corresponding to a particular category recurs at equidistant intervals along each level.

The preferred embodiment of the present invention also comprises six tetrahedral playing pieces 20, each of a different colour to differentiate therebetween. There are six packs of question cards 30, each of a different game colour representative of a particular category of question (e.g. the six categories could be: companies; economics and politics; advertising; initials and abbreviations; media and people; and professions). Each question card has six questions of six different levels of difficulty printed on one side and the answers to the six questions printed on the other side. A 'category' dice 40 consists of six differently coloured faces, each face representative of said different categories of question, and a 'difficulty' dice 50 consists of six differently numbered faces ranging from 1 to 6, each representative of a rating for selecting different difficulties of question.

To play the game the playing board 10 is opened up and placed on a flat surface, such as a table or the floor. The playing pieces 20 are placed on the white start triangle 12.

denoted by the letter S, the number of playing pieces thereon being representative of the number of players.

The distinction must first be made between a level, of which there are five, and a row, of which there are two within each level. Players move from one end of a level to the other and can move in either of the two rows of triangles 11 depending on the colour thrown on the category dice 40. Players can move up or down between the rows provided they are always moving forwards in a systematic boustrophedon manner. For example, if they throw on the category dice 40 the colour of the triangle 11 directly above/below their position within a level, they do not move up/down to it, but move forward to the next triangle 11 of that colour thrown whether it is on the top or bottom row. The numbered difficulty dice 50 has no influence on the movement of pieces.

Each player starts from the start triangle 12 in the bottom right-hand corner of the board 10 and throws both the category dice 410 and difficulty dice 50. The player moves his playing piece 20 to the next triangle 11 of a colour shown by the category dice 40, moving in whichever of the two rows is necessary to facilitate a net horizontal move towards the hexagon 17 at the end of that level. An opponent player asks a question from that colour category card 30, choosing which question from the available six by the number indicated on the difficulty dice 50. For instance, if a player throws 'blue' and '4' he would move to the next blue triangle (blue triangles being in the bottom row of each level) along the playing path and one of his opponents would select a blue category question card 30 and ask question number 4 on that card.

If the player answers correctly his turn continues. Very simply, he should aim to reach the hexagon 17 at the end of the level he is on. Once in a hexagon 17, the player may choose any category and move his piece to the corresponding colour in the hexagon 17. He must then throw the difficulty dice 50 alone, to select the level of difficulty. If answered correctly, the player is promoted to the next level and moves to the white 'P' triangle 13 above. If the player has answered incorrectly then his turn is ended and on his next turn he must move his piece clockwise to the next triangle 11 in the hexagon 17, again throwing the difficulty dice 50. This process continues until he is successful in answering a question, at which point he would be able to gain promotion. In any case, when a question is answered incorrectly the player's turn is ended. In the simple case, the player continues to negotiate up the board in a boustrophedon manner, always aiming to get to the hexagon 27 on his level (tactical promotion and demotion will be discussed later).

On promotion to the boardroom the player must throw both dice 40, 50 in the normal manner, but the player must move to whatever colour is indicated by the category dice 40. Incorrect answers end the players turn and on his next turn he must throw both dice 40, 50 again and move to that triangle 11 within the boardroom. As soon as a question is correctly answered in the boardroom the player moves up into the chairman's triangle 15 denoted by a 'C'. Once a player has reached the chairman's triangle 15 they have the opportunity to win the game. Now the player must choose two game categories and throw the difficulty dice 50 twice, once for each category. Two correct answers win the game.

However, if a mistake is made the player is demoted one level for each question incorrectly answered. Consequently, one mistake means demotion to the boardroom and two mistakes means demotion to the senior management level. The player is demoted a level down to the black 'D' triangle 14 on that level. On his next turn the player must re-enter the hexagon 17 with his choice of category in the manner previously described, but if he has only been demoted to the boardroom he must throw both dice 40, 50. Once in the boardroom he cannot be challenged by other players landing on the 'B' triangle 18.

When a player succeeds in getting promoted onto any one of the three white triangles 13 denoted by a 'P', tactics must be considered and may be employed. There are three simple options.

Option 1—continue playing by throwing both dice 40, 50 and moving in the normal way. This strategy minimises risk by keeping control.

Option 2—a player can try to advance himself more quickly to the coloured triangles 16 also denoted with a 'P' mid way along the level just reached. To do this the player must ask his opponents to choose the category of question to be answered. The player then throws the difficulty dice 50. A correct answer results in a move to the coloured 'P' triangle 16 midway along the level and the player's turn continues. An incorrect answer results in demotion and the player must drop back to the black 'D' triangle 14 immediately below and the turn ends. The benefit is obvious with this self-risk strategy, but success depends on strength of knowledge of a player's weakest subject.

Option 3—finally, and the most destructive option is to challenge another player, but once again the player must weigh up the risk. When a player lands on the white 'P' triangle 13 he can select any player still on that level, whether they are in the hexagon 17 at the other end or not. He selects a category for them and they throw the difficulty dice 50. If they answer incorrectly they must go back to the black 'D' triangle 14 on the level below. The challenger's turn then continues. However, if the challenged player answers correctly then the challenger is demoted to the 'D' triangle 14 immediately below, and lose their turn. If the challenge is successful the turn continues with the challenged player having been demoted. A demoted player can quickly gain promotion and so revenge may be swift.

Throughout the specification reference has been made to one particular game format which typically comprises an organisational hierarchy. However, it will be appreciated that the game format is not limited to the preferred embodiment herein described. Indeed, said game format may comprise any particular realistic or identifiable situation which contributes the further dimension of player interaction and direct challenge, which further dimension influences or determines the outcome of the game and does not limit it to probability or question answering alone.

The preferred embodiment of the present invention has been described as apparatus comprising a game board 10 and associated playing means (20, 30, 40, 50). However, the present invention is not limited to said board means, and it will be appreciated that the game could be equally well applied to apparatus comprising electrical or electronic apparatus, typically a computer 100, which electric or electronic apparatus has display means 101 and input means comprising a keyboard 102 and a mouse 103. The board 10 will be shown on the screen during play. The computer 100 will act as a randomiser in place of the dice 40, 50 in the board version of the game and will move playing pieces along the displayed path automatically, displaying questions to be answered on the screen for the player to answer by using the keyboard 102 as an input device (or the mouse 103 if multiple choice answers were displayed on the screen). The option for a player to challenge others or to ask other to challenge himself will appear automatically on the screen at the appropriate point of play and the computer 100 will automatically select and display questions when the chairman's position is reached by a player.

I claim:

1. Apparatus for playing a game comprising a plurality of playing pieces, a board marked in a particular manner and a plurality of question cards, the playing pieces being movable in accordance with specified rules; wherein:

a playing path is defined on the board along which the playing pieces are moved during the game;

the playing path comprises a plurality of segments defining locations for the playing pieces during a game, the segments being of a plurality of different identifiable types;

the questions cards are divided into a plurality of different categories, the number of categories of question cards matching the number of types of segments;

the rules specify that when a playing piece is placed on a segment a player must answer a question from a question card of a category determined by the type of segment;

the playing path is divided into at least three levels, the rules specifying that the playing pieces must start on a first level and then move through at least one intermediate level to an ultimate level;

the levels of the slaying path are each of a different length in terms of the number of segments in the level, the first level being of the longest length, the ultimate level being of the shortest length, and the intermediate levels decreasing in length;

the rules specify that to move a playing piece from a first level to a second level nearer to the ultimate level or from a penultimate intermediate level to the ultimate level, a player must answer correctly a question read from a question card;

the board is a triangle with the first level extending across a base of the triangle and the ultimate level being located at an apex of the triangle;

at the ends of each of the first and intermediate levels on the playing path there is provided a hexagonal arrangement of triangular segments representing all the types of segments; and the rules specify that a playing piece reaching the end of the first or an intermediate level must be placed on any one of the triangular segments in the hexagonal arrangement, selected by the player, and the player must answer a question from a question card of a category determined by the type of segment, and if the player incorrectly answers the question, the playing piece must be moved in a consistent direction from that triangular segment in the hexagonal arrangement to a neighboring triangular segment with each turn of play of a player until the player correctly answers a question, at which point the player can move the playing piece to a level nearer the ultimate level, or from a penultimate intermediate level to the ultimate level.

2. Apparatus as claimed in claim 1 wherein the segments are each triangular and each layer comprises two rows of tessellated triangular segments, an upper row and a lower row, the rules specifying that a playing piece can be moved between the upper and the lower paths during the game provided that the playing piece moves along the layers in a boustrophedon manner.

3. Apparatus as claimed in claim 1 comprising a first dice which can be thrown by a player to determine which type of segment his playing piece should next be moved to and thereby what category of question should be read from a question card and answered.

4. Apparatus as claimed in claim 3 wherein on each question card there are printed a plurality of different questions of the same category but different degrees of difficulty and the game comprises a second dice which can be thrown by a player to determine the selection of the degree of difficulty of a question to be read and answered.

5. Apparatus as claimed in claim 1 where the types of segments are distinguished by different colours, the question cards of each category each having a portion of a colour matching the colour of one type of segment and a first dice has different colours on different faces, each colour on each face of the first dice matching a colour of a type of segment and category of question card.

6. Apparatus as claimed in claim 1 wherein the rules specify that when a first player moves a playing piece from one level to a new level nearer the ultimate level the player has an option to require any player having a playing piece on the new level to answer a question read from a question card and if the question is answered incorrectly, then the playing piece of the player who has answered incorrectly is moved to a level further distant from the ultimate level.

7. Apparatus as claimed in claim 1 wherein the rules specify that when a player moves a playing piece from one level to a new level he can require another player to ask a question read from a question card and if the question is answered correctly then the playing piece of the first player is advanced along the new level to a specified segment and if the question is answered incorrectly then the playing piece of the first player is moved from the new level to a level further distance from the ultimate level.

8. Apparatus as claimed in claim 1 wherein the rules specify that when a playing piece reaches the ultimate level a player must answer a plurality of questions correctly to win the game and if any question is answered incorrectly then the playing piece is moved to an intermediate layer.

9. Apparatus for playing a game comprising electrical or electronic apparatus having display means and input means for use by a plurality of players wherein the display means during the game displays a playing path, playing pieces movable along the playing path and text of questions and corresponding answers, the playing pieces being movable in accordance with specified rules, wherein:

the displayed playing path comprises a plurality of segments defining locations for the playing pieces during the game, the segments being of a plurality of different identifiable types;

the questions are categorized into a plurality of different categories, the number of categories of the questions matching the number of types of segment;

the apparatus when a playing piece reaches a segment displays a question of a category determined by the type of segment;

the playing path is divided into at least three levels, and the apparatus requiring each playing piece to start at a first level and then move through at least one intermediate level to an ultimate level;

the apparatus requiring that a question is correctly answered before moving a playing piece from a first level to a second level to nearer the ultimate level or from a penultimate level to the ultimate level;

at the ends of each of the first and intermediate level on the playing oath, there is displayed a hexagonal arrangement of triangular segments representing all the types of segments; and the apparatus requires that a playing piece reaching the end of the first or an intermediate level must be entered on any one of the triangular segments in the hexagonal arrangement, selected by the player, and the player must answer a question from a question card of a category determined by the type of segment, and if the player incorrectly answers the question, the playing piece must be moved in a consistent direction from that triangular segment in the hexagonal arrangement to a neighboring triangular segment with each turn of play of a player until the player correctly answers a question, at which point the playing piece is moved to a level nearer the ultimate level, or from a penultimate intermediate level to the ultimate level.

10. Apparatus as claimed in claim 9 wherein the levels of the playing path are each of a different length in terms of the number of segments in the level, the first level being of a longest length and the ultimate level being of the shortest length and the intermediate level decreasing in length progressively.

11. Apparatus as claimed in claim 10 wherein the displayed segments are each triangular and each layer comprise two row of tessellated triangular segments, an upper row and a lower row, the apparatus allowing a playing piece to move between the upper and lower paths during the game provided that the playing piece moves along the layers in a boustrophedon manner.

12. Apparatus as claimed in claim 9 comprising a first randomiser which can be used by a player to determine which type of segment this playing piece should next be moved to and thereby what category of question should be displayed and answered.

13. Apparatus as claimed in claim 12 wherein the apparatus for each category can display questions of different degrees of difficulty and the apparatus comprises a second randomiser which can be used by a player to determine the selection of the degree of difficulty of a question to be displayed and answered.

14. Apparatus as claimed in claim 9, wherein when a playing piece moves from one level to a new level nearer the ultimate level a player is given an opportunity to select that another player having a playing piece on the new level is posed a displayed question and if the question is answered incorrectly then the playing piece of the player who has answered incorrectly is moved to a level further distant from the ultimate level.

15. Apparatus as claimed in claim 9 wherein when a playing piece is moved from one level to a new level the apparatus gives a player the opportunity to require another player to select a category of question to be displayed and if the question is answered correctly then the playing piece is advanced along the new level to a specified segment and if the question is answered incorrectly then the playing piece is moved from the new level to a level further distant from the ultimate level.

16. Apparatus as claimed in claim 9 wherein when a playing piece reaches tho ultimate level the apparatus requires a player to answer a plurality of questions correctly to win the game and if any question is answered incorrectly then the playing piece of the player is moved to an intermediate layer.

* * * * *

UNITED STATES PATENT AND TRADEMARK OFFICE

CERTIFICATE OF CORRECTION

PATENT NO. : 5,758,877

DATED : June 2, 1998

INVENTOR(S) : Thomas W. Liddell

It is certified that error appears in the above-identified patent and that said Letters Patent is hereby corrected as shown below:

Column 6, line 65, cancel "oath" and insert --path--.

Signed and Sealed this

Fifth Day of September, 2000

*Attest:*

*Attesting Officer*

Q. TODD DICKINSON

*Director of Patents and Trademarks*